US005165334A

United States Patent [19]

Aluotto et al.

[11] Patent Number: 5,165,334

[45] Date of Patent: Nov. 24, 1992

[54] APPARATUS FOR RECYCLING OIL FILTERS

[76] Inventors: Joseph Aluotto, 265 Nippon Ave., Staten Island, N.Y. 10312; Dominic Aluotto, 3906 Fillmore Ave.; Peter A. Aluotto, 1668 Hendrickson St., both of Brooklyn, N.Y. 11234

[21] Appl. No.: 791,062

[22] Filed: Nov. 12, 1991

[51] Int. Cl.[5] ..... B30B 9/06; B30B 9/32; B30B 15/32

[52] U.S. Cl. ..... 100/112; 100/125; 100/218; 100/902

[58] Field of Search ..... 100/53, 112, 125, 131, 100/218, 245, 246, 902

[56] References Cited

U.S. PATENT DOCUMENTS

| | | | |
|---|---|---|---|
| 2,613,592 | 10/1952 | Nemir | 100/218 X |
| 2,642,106 | 6/1953 | Coffey et al. | 100/53 X |
| 2,667,118 | 1/1954 | Nelson | 100/218 X |
| 2,789,293 | 4/1957 | Maeser | 100/218 X |
| 3,025,837 | 3/1962 | Beach | 100/218 X |
| 3,185,071 | 5/1965 | Foss et al. | 100/218 X |
| 3,185,072 | 5/1965 | Rickard | 100/218 X |
| 3,272,116 | 9/1966 | White et al. | 100/218 X |
| 4,463,670 | 8/1984 | Thomas | 100/53 X |
| 4,927,085 | 5/1990 | Oberg | 100/131 X |

*Primary Examiner*—Harvey C. Hornsby
*Assistant Examiner*—Stephen F. Gerrity
*Attorney, Agent, or Firm*—Kane, Dalsimer, Sullivan, Kurucz, Levy, Eisele and Richard

[57] ABSTRACT

An improvement for an apparatus for recycling oil filters enables crushed oil filters to be removed from the compartment, in which they are crushed to remove used oil therefrom and to render them safely disposable, by a mechanical means. The improvement involves the use of a U-shaped member disposed through an opening at the base of the crushing compartment. Mechanical means pull the arms of the U-shaped member from the crushing compartment, thereby enabling the base of the U-shaped member to sweep crushed oil filters out through the opening. The crushing compartment has a door which need only be opened to introduce oil filters to be crushed.

6 Claims, 5 Drawing Sheets

APPARATUS FOR RECYCLING OIL FILTERS

BACKGROUND OF THE INVENTION

1. Field of the Invention

The present invention relates generally to the fields of waste disposal and scrap salvaging. More specifically, it relates to a mechanism for reclaiming oil from used oil filters by crushing them into a compact form. At the same time, the crushed oil filters may then be safely disposed or salvaged.

2. Description of the Prior Art

Standard replaceable automotive oil filters have metal outer casing and inner filter elements to trap impurities. In the past, spent or used filters were simply disposed of with other trash. It is now recognized, however, that when large numbers of spent oil filters are accumulated and disposed of together in such a manner, environmental damage may follow.

In recent years, mechanisms for recycling the oil trapped in spent oil filters have been devised. One such mechanism, shown in U.S. Pat. No. 4,927,085, comprises a specialized crusher including an upright compartment sized to receive an individual oil filter, which may rest on a grate at the bottom thereof. A crusher plate above the filter is guided for vertical sliding movement in the compartment and is moved up and down by a hydraulic jack. Downward movement of the crusher plate collapses the oil filter casing to compact condition and oil contained in it passes through the bottom grate into a spout leading to a receptacle. When a desired pressure has been reached, the jack automatically lifts the crusher plate and the collapsed casing can be removed for salvaging. All components of the apparatus are incorporated in a compact cabinet which may have bottom drawer for the oil receptacle and a bin in which the collapsed casings can be collected.

A disadvantage of mechanisms of this type resides in the fact that its operator must remove the crushed casings manually from the crushing compartment. This disadvantage exposes the operator to the likelihood that he will get oil all over his hands when removing the crushed casings from the compartment, and to the possibility that he will have his hands cut by jagged metal edges of the crushed casings when doing so.

The present invention is an improvement for an apparatus for recycling oil filters which obviates these deficiencies in the prior art by comprising a crushing compartment which includes a means by which obviates these deficiencies in the prior art by comprising a crushing compartment which includes a means by which the crushed casings of used oil filters may be swept from the compartment into a receptacle without requiring the operator to introduce his hand into the crushing compartment to manually remove the crushed casings therefrom.

SUMMARY OF THE INVENTION

The present invention is an improvement for an apparatus for recycling oil filters having a crushing compartment which includes a means by which the crushed casings of used oil filters may be swept from the crushing compartment into a receptacle without opening the crushing compartment More specifically, the present invention is an improvement for an apparatus for recycling oil filters, wherein the apparatus itself comprises a crushing compartment sized to accommodate at least one oil filter to be crushed. The crushing compartment includes a base on which the oil filter may be placed. The base is provided with passages therethrough to recover and collect the oil pressed from an oil filter. The apparatus also includes a crusher plate mounted for movement within the crushing compartment toward and away from the base, and means for moving the crusher plate toward the base with sufficient force to crush an oil filter and for withdrawing the crusher plate to permit the removal of a crushed oil filter from the crushing compartment.

According to the present improvement for such an apparatus, the crushing compartment is defined by four side walls and a base. One of the side walls is separated from the base providing a first opening in the crushing compartment for removing a crushed oil filter therefrom.

A U-shaped member, having a width dimension essentially equal to that of the base of the crushing compartment, and arms longer than the length dimension of the base, is inserted into the crushing compartment through this first opening. The U-shaped member, which more or less coincides with the perimeter of the base inside the crushing compartment, is provided with means for being moved back and forth over the base, enabling it to be used to sweep a crushed oil filter out through the first opening without opening, and to sweep any oil remaining on the base toward the first opening, from which it may drip into the receptacle provided therefor.

The present invention will be described more fully below with reference being made to the various figures, which are identified below.

DETAILED DESCRIPTION OF THE PREFERRED EMBODIMENT

Figure 1:
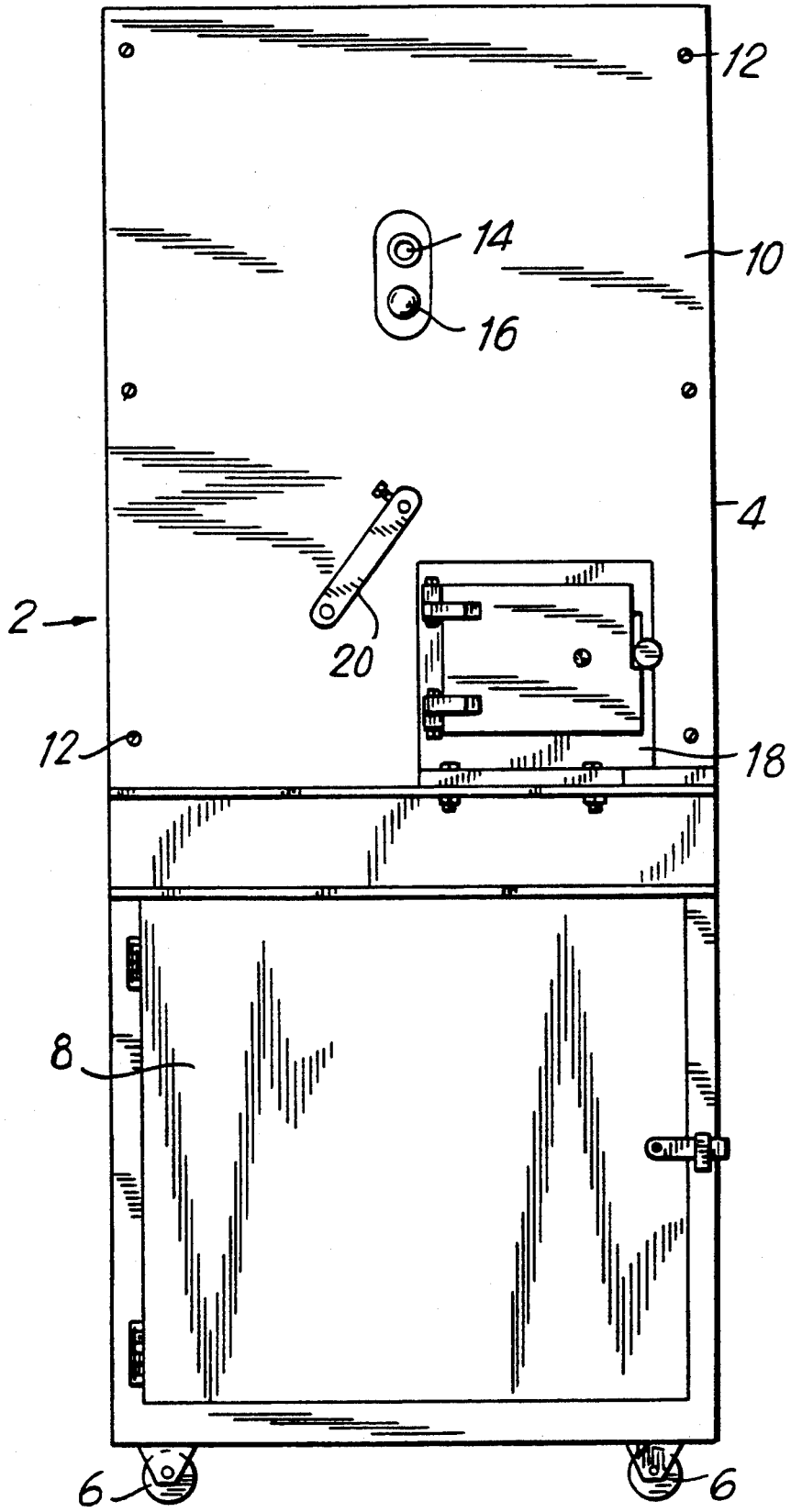
FIG. 1 depicts an apparatus for recycling oil filters of the variety in which the present improvement could be employed.

With reference first to FIG. 1, an apparatus 2 for recycling oil filters may be incorporated into a cabinet 4 mounted on casters 6, enabling the apparatus 2 to be moved readily from place to place.

In the lower half of the cabinet 4 is a compartment, access to which is gained by opening door 8, where receptacles for collecting used oil obtained by crushing the oil filters and the crushed filters themselves may be placed. In the upper half of the cabinet 4, covered with panel 10 secured by screws 12 in FIG. 1, is the mechanism which crushes the oil filters. Shown in FIG. 1 are a button 14 to activate the mechanism, and a light 16 to indicate the mechanism has been so activated.

Finally, in FIG. 1, a crushing compartment 18 and a crank 20, by which crushed oil filters may be removed from the crushing compartment 18, are visible.

Figure 2:
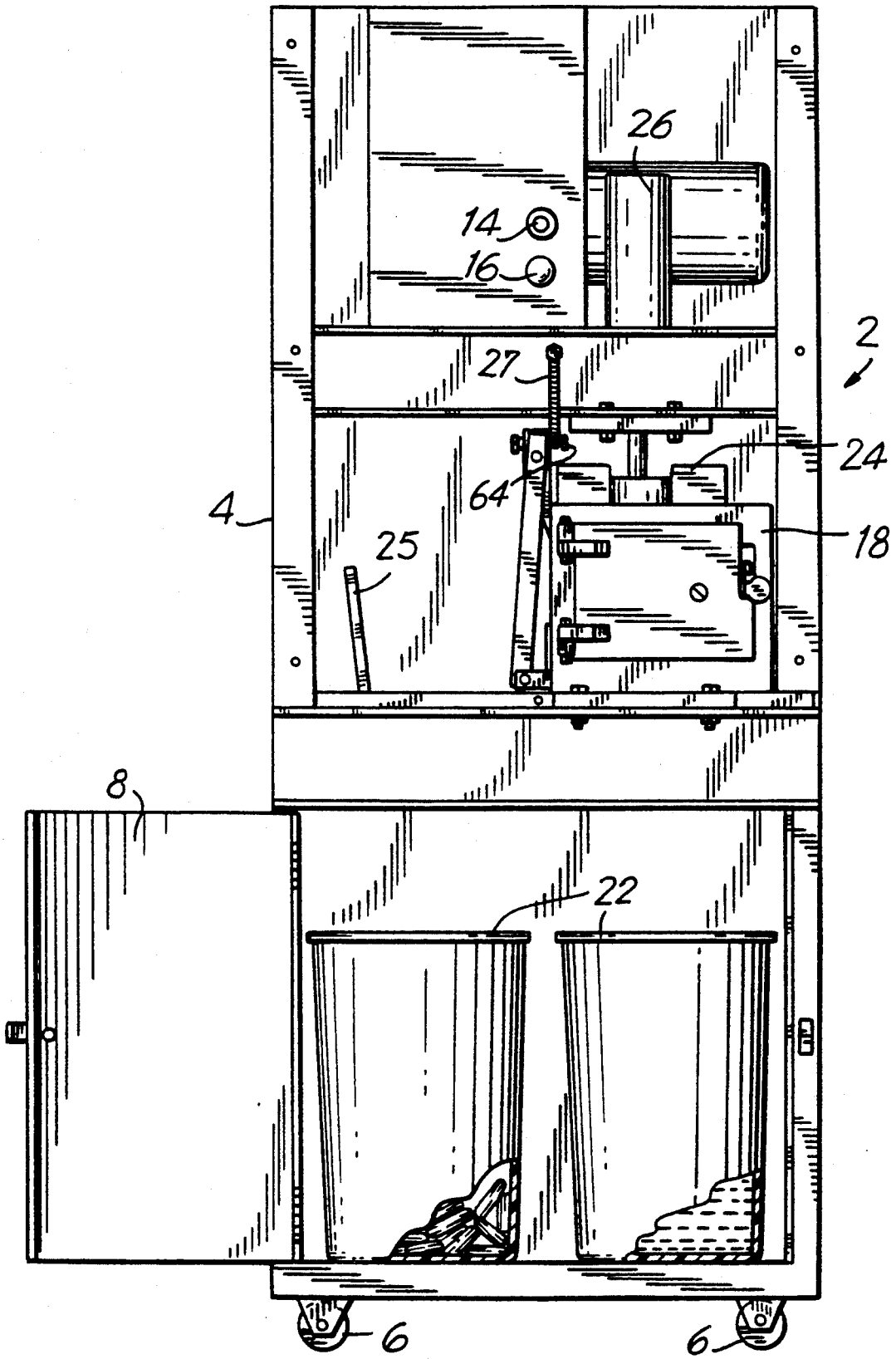
FIG. 2 depicts the apparatus shown in FIG. 1 with the front panel removed and door opened to expose the interior thereof.

Turning now to FIG. 2, the apparatus 2 is shown following the removal of panel 10 and the opening of door 8. In the lower half of the cabinet 4, the receptacles 22 for oil and crushed oil filters are shown, that for the oil being directly below the crushing compartment 18. In the upper half of the cabinet 4, in addition to elements previously mentioned above, are shown in the crusher plate 24, and the means 26 for moving the crusher plate 24 to crush an oil filter within crushing compartment 18 and to withdraw the crusher plate 24 after an oil filter has been crushed. Crank 20 has been removed to permit panel 10 to be removed from cabinet 4.

Also shown in FIG. 2 are a stop plate 25 and a spring 27, the purpose of both of which will be set forth hereinbelow.

The present invention is an improvement for an apparatus 2 of this variety. The improvement itself resides in the crushing compartment 18 itself, shown in greater detail in FIGS. 3 and 4.

Figure 3:
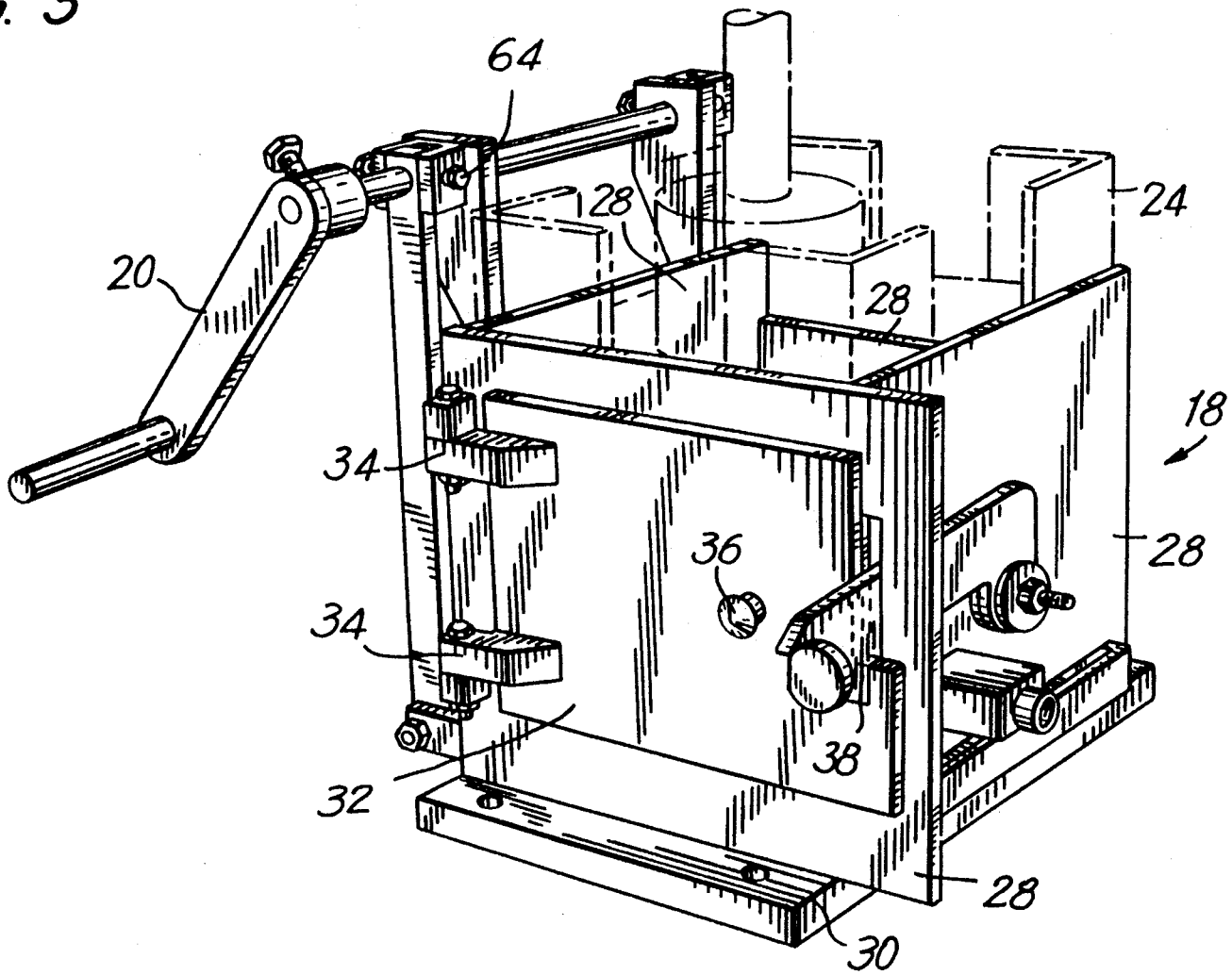
FIG. 3 is a view of a crushing compartment for an apparatus for recycling oil filters incorporating the improvement of the present invention.

FIG. 3 is a front view of the crushing compartment 18, and includes, for completeness, crank 20 in its proper position. The crushing compartment 18 is defined by four side walls 28 and a base 30. Crusher plate 24, not a part of the crushing compartment 18 of the present invention, is shown in its fully retracted, or raised, position by a dashed-line outline.

One of side walls 28 has a door 32 for access to the interior of the crushing compartment 18, as shown in FIG. 3. The door 32 may be mounted on hinges 34, and may be provided with a knob 36 and a latch 38.

Figure 4:
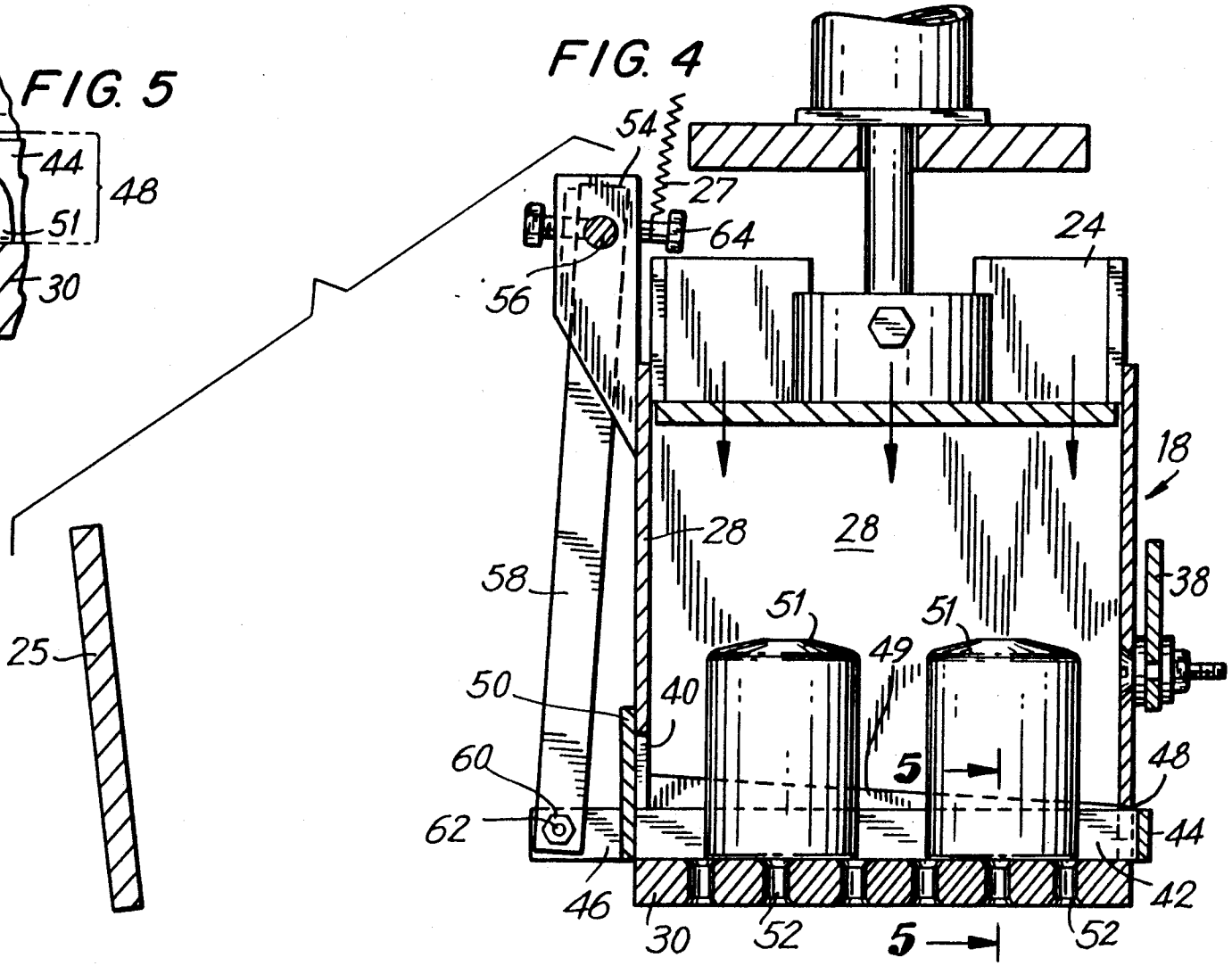
FIG. 4 is a sectional view of the crushing compartment.

With reference now to FIG. 4, a sectional view of the crushing compartment 18, also showing stop plate 25 and crusher plate 24, another of the side walls 28 is separated from the base 30 to provide a first opening 40 in the crushing compartment 18 for removing a crushed oil filter therefrom without opening door 32. First opening 40 extends for the width of the base 30.

A U-shaped member 42 is disposed on the base 30. The U-shaped member 42 has a base 44 with a width substantially equal to the width of base 30, and has arms 46 extending from base 44. The arms 46 have a length greater than the length of base 30, so that they extend out through first opening 40 when the base 44 of the U-shaped member 42 is adjacent to the side wall 28 opposite the first opening 40. Side wall 28 opposite the first opening 40 may be provided with a second opening 48, which, like first opening 40, extends for the width of the base 30 to accommodate the base 44 of the U-shaped member 42. Arms 46 may be disposed in recesses 49 adjacent to the base 30 in the other two side walls 28, so that they may not be damaged by crusher plate 24.

A plate-like member 50, attached to the arms 46 of the U-shaped member 42 and extending therebetween in a direction substantially parallel to the base 44 of the U-shaped member 42, may be used to substantially cover first opening 40 from outside the crushing compartment 18 when the base 44 of the U-shaped member 42 is adjacent to the side wall 28 opposite the first opening 40, that is, when an oil filter is in the process of being crushed in the crushing compartment 18. A pair of oil filters 51 are also shown resting on base 30 of crushing compartment 18.

Figure 5:
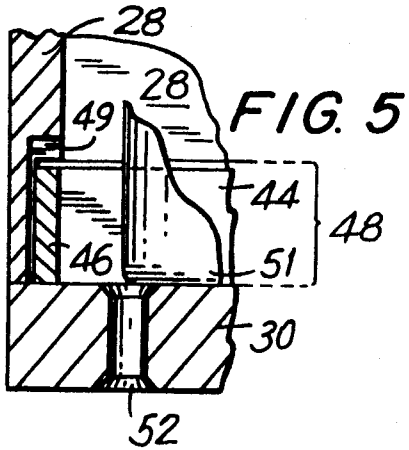
FIG. 5 is an enlarged sectional view taken as indicated by line 5—5 in FIG. 4.

The base 30 of crushing compartment 18 may be provided with a plurality of holes 52, so that used oil from a crushed oil filter may drain therethrough from the crushing compartment 18. Holes 52 are also shown in the enlarged sectional view, taken as indicated by line 5—5 in FIG. 4, provided in FIG. 5. It may also be seen in FIG. 5 that arm 46 is disposed in a recess 49 adjacent to the base 30 in side wall 28, and that base 44 of U-shaped member 42 may pass through second opening 48 in the other side wall 28.

The U-shaped member 42 may be moved back and forth across the base 30 to sweep a crushed oil filter from the crushing compartment 18 through first opening 40 as follows. Above first opening 40 on side wall 28 are mounted a first and a second axle-holding member 54, each having a hole to accommodate axle 56. A first and a second elongated members 58 extend from axle 56, to which they ar rigidly affixed adjacent to the first and second axle-holding members 54, respectively, down to the arms 46 of the U-shaped member 42. Each of the first and second elongated members 58 is attached to an arm 46 of U-shaped member 42 by such means as a nut 60 and bolt 62. Finally, crank 20 is also rigidly affixed to axle 56, although for the sake of clarity this is not shown in FIG. 4.

Figure 6:
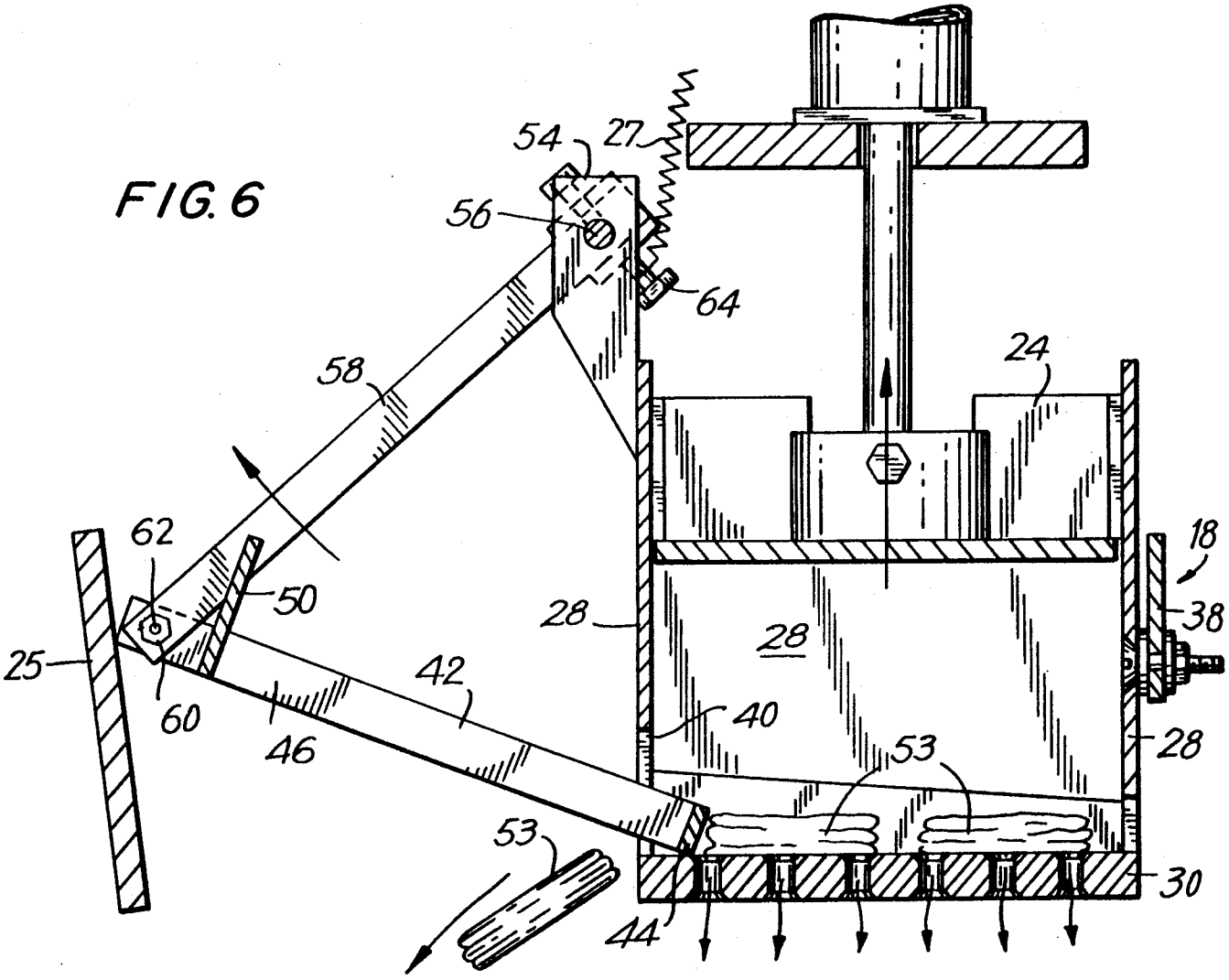
FIG. 6, like FIG. 4, is a sectional view of the crushing compartment of the present invention showing the removal of a crushed oil filter therefrom.

Referring together to FIGS. 4 and 6, the latter of which shows the removal of a crushed oil filter 53 from crushing compartment 18, it should now be clear how the present invention operates. By turning crank 20, which, it will be recalled, is disposed outside panel 10 on apparatus 2 in FIG. 1, and which is attached to axle 56, in a clockwise direction, first and second elongated members 58 pull arms 46 of U-shaped member 42 to the left in FIG. 4, thereby sweeping the base 44 of U-shaped member 42 across base 30 of crushing compartment 18 to remove any crushed oil filter 53 therefrom through first opening 40, and to sweep any remaining oil, which has not drained through passages 52, toward first opening 40 from which it may drip into one of the receptacles 22 disposed therebelow. Thereafter, turning crank 20 in a counterclockwise direction will restore the crushing compartment 18 to the configuration shown in FIG. 4.

Referring again to FIGS. 4 and 6, it may now be observed that stop plate 25, which is mounted adjacent to crushing compartment 18 in cabinet 4 in FIG. 2, prevents U-shaped member 42 from being completely withdrawn from crushing compartment 18 when crank 20, which is attached to axle 56, is turned in a clockwise direction.

Further, referring again to FIG. 2, spring 27 may be extended between a fixed member of cabinet 4 to bolt 64. As may be observed in FIGS. 4 and 6, bolt 64 is attached to axle 56. When crank 20 is turned in a clockwise direction to clear crushing compartment 18 of a crushed oil filter 53, spring 27 will be stretched beyond its normal length. Spring 27 will thereby generate a restoring force, which will help to return U-shaped member 42 completely within the crushing compartment 18, thereby restoring the crushing compartment 18 to the configuration shown in FIG. 4.

Modifications to the above would be obvious to those skilled in the art without bringing a device so modified beyond the scope of the appended claims.

What is claimed is:

1. In an apparatus for recycling an oil filter, said apparatus including a crushing compartment sized to accommodate at least one oil filter to be crushed to recover used oil therefrom and having a base on which an oil filter may be placed for crushing, said base being provided with passages therethrough for the recovery of used oil from a crushed filter, said apparatus also including a crusher plate mounted for movement lengthwise of said crushing compartment toward and away from said base, and means for moving said crusher plate within said compartment toward said base with sufficient force to crush an oil filter and for withdrawing said crusher plate away from said base to permit a crushed oil filter to be removed, the improvement comprising:

said crushing compartment being defined by four side walls and said base, said base having a length and a width measured inside said crushing compartment, one of said side walls having a door for access to said crushing compartment and another of said side walls being separated from said base to provide a first opening in said crushing compartment for removing a crushed oil filter therefrom without opening said door, said first opening extending for said width of said base;

a U-shaped member, said U-shaped member having a base with a width substantially equal to said width of said base of said crushing compartment and having arms extending from said base, said arms having a length greater than said length of said base of said crushing compartment, so that said arms of said U-shaped member may extend out through said first opening in said crushing compartment when said base of said U-shaped member is adjacent to said side wall of said crushing compartment opposite said first opening; and means for moving for moving said U-shaped member back and forth upon said base of said crushing compartment, so that said base of said U-shaped member may sweep a crushed oil filter from said crushing compartment through said first opening.

2. The improvement in an apparatus for recycling an oil filter as claimed in claim 1 further comprising:

a plate-like member, said plate-like member being attached to said arms of said U-shaped member and extending therebetween in a direction substantially parallel to said base of said U-shaped member, said plate-like member substantially covering said first opening in said crushing compartment from outside when said base of said U-shaped member is adjacent to said side wall of said crushing compartment opposite said first opening.

3. The improvement in an apparatus for recycling an oil filter as claimed in claim 1 wherein said base of said crushing compartment is perforated with a plurality of holes, so that used oil from a crushed oil filter may drain therethrough from said crushing compartment.

4. The improvement in an apparatus for recycling an oil filter as claimed in claim 1 wherein said means for moving said U-shaped member back and forth upon said base of said crushing compartment comprises:

a first and second axle-holding member, said axle-holding members extending from said side wall of said crushing compartment above said first opening and each having a hole therethrough to accommodate an axle;

an axle, said axle being directed through said holes in said first and second axle-holding members and extending therebetween;

a first and a second elongated member, said first elongated member being rigidly fixed to said axle adjacent to said first axle-holding member, and extending and attached to one of said arms of said U-shaped member, projecting through said first opening, said second elongated member being rigidly fixed to said axle adjacent to said second axle-holding member, and extending and attached to the other of said arms of said U-shaped member projecting through said first opening; and a crank, said crank being attached to an end of said axle, so that, by turning said crank, said base of said U-shaped member may sweep a crushed oil filter from said crushing compartment through said first opening.

5. The improvement in an apparatus for recycling an oil filter as claimed in claim 1 wherein said side wall of said crushing compartment opposite said first opening is separated from said base to provide a second opening in said crushing compartment, said second opening extending for said width of said base, said second opening sized to accommodate said base of said U-shaped member when an oil filter is being crushed.

6. The improvement in an apparatus for recycling an oil filter as claimed in claim 1 wherein said side walls parallel to said arms of said U-shaped member have recesses for said arms, so that said arms may not be damaged when an oil filter is being crushed in said crushing compartment.

* * * * *